US007733001B2

(12) United States Patent
Yamada et al.

(10) Patent No.: US 7,733,001 B2
(45) Date of Patent: Jun. 8, 2010

(54) LIGHT SOURCE DEVICE

(75) Inventors: Koji Yamada, Himeji (JP); Tetsuji Hirao, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 597 days.

(21) Appl. No.: 11/678,866

(22) Filed: Feb. 26, 2007

(65) Prior Publication Data

US 2007/0200472 A1 Aug. 30, 2007

(30) Foreign Application Priority Data

Feb. 28, 2006 (JP) ..... 2006-052527

(51) Int. Cl.
*H01J 5/16* (2006.01)

(52) U.S. Cl. ..... 313/113; 313/493; 313/634

(58) Field of Classification Search ..... 313/25, 313/113–115, 493, 634
See application file for complete search history.

(56) References Cited

U.S. PATENT DOCUMENTS 4,156,901 A 5/1979 Haraden et al.
5,119,282 A 6/1992 Meyer et al.
6,461,020 B2 10/2002 Horikawa

FOREIGN PATENT DOCUMENTS

| | | | |
|---|---|---|---|
| EP | 0 457 645 | A2 | 11/1991 |
| EP | 1 298 703 | A2 | 4/2003 |
| FR | 2 454 051 | A1 | 7/1980 |
| GB | 2 066 443 | A | 7/1981 |
| GB | 2 162 995 | A | 2/1986 |
| JP | 2000-105425 | A | 4/2000 |
| JP | 2003-029338 | A | 1/2003 |

*Primary Examiner*—Vip Patel
(74) *Attorney, Agent, or Firm*—David S. Safran; Roberts Mlotkowski Safran & Cole, P.C.

(57) ABSTRACT

To devise a light source device with a low price and from which a sufficient amount of light can be obtained, in a light source device having a reflector and a discharge lamp, a hermetically sealed portion of the lamp is directly joined to a part of a neck region of the reflector with a processed portion being formed for setting the positional relationship between the lamp and reflector.

6 Claims, 7 Drawing Sheets

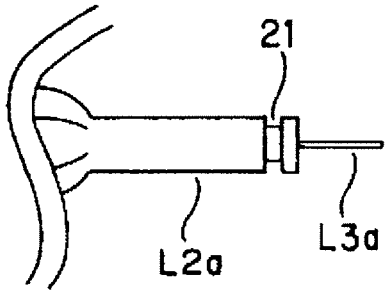
Fig. 2 (a)
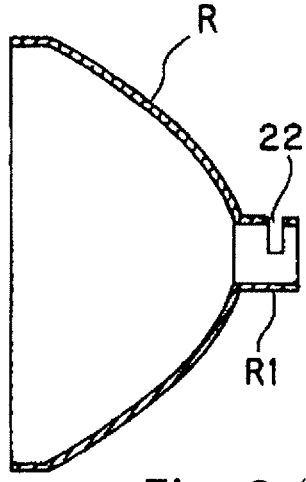
Fig. 2 (b)
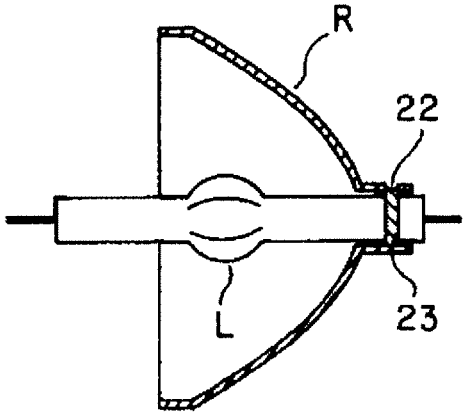
Fig. 2 (c)
Fig. 2 (d)
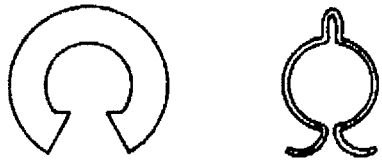
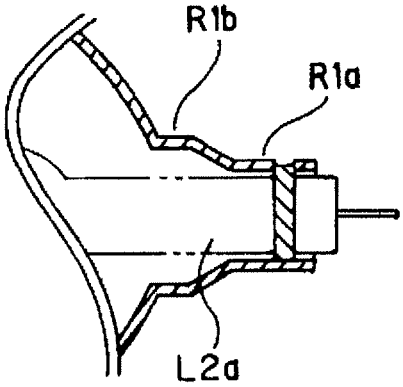
Fig. 2 (e)

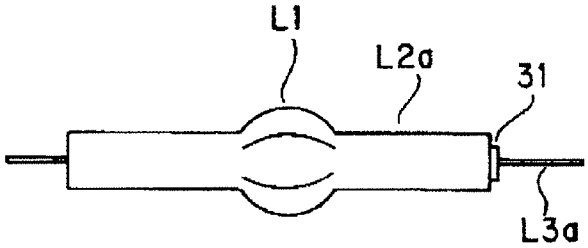
Fig. 3 (a)
Fig. 3 (b)
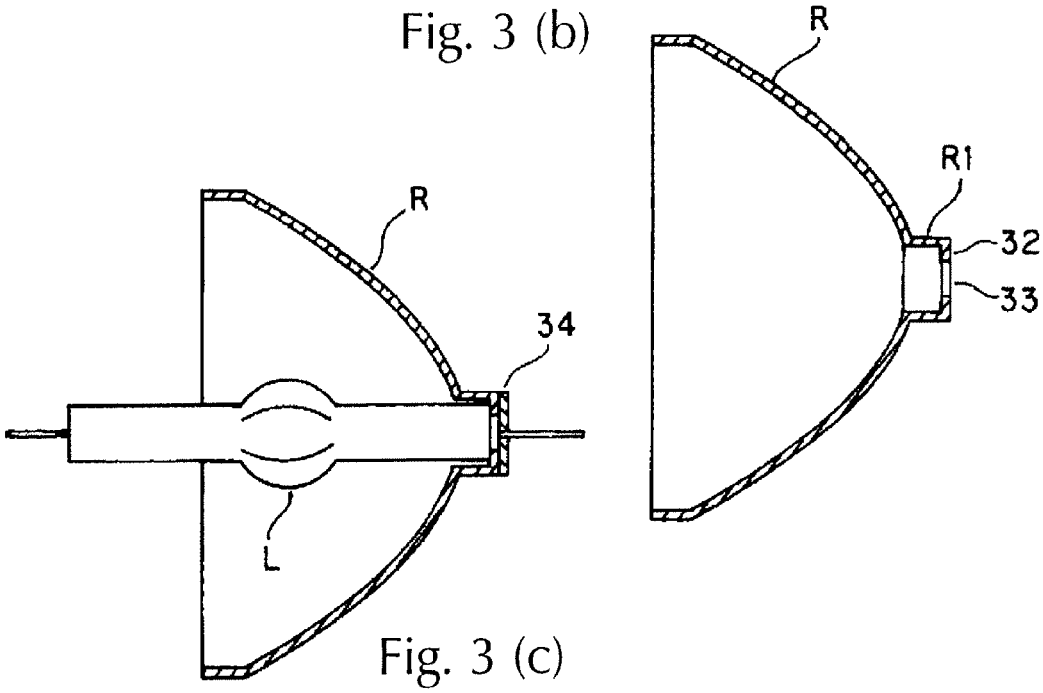
Fig. 3 (c)
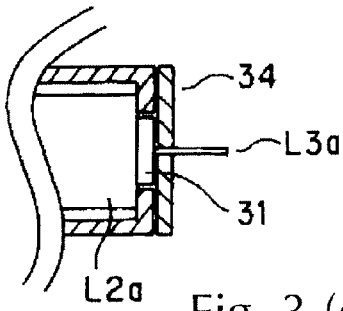
Fig. 3 (d)
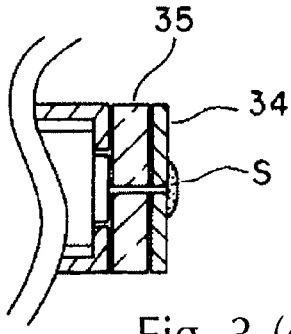
Fig. 3 (e)

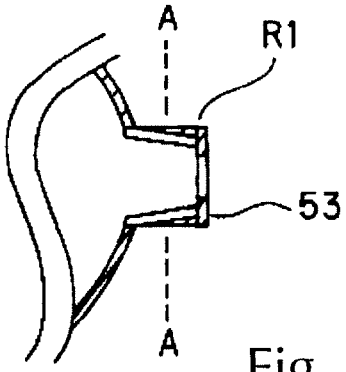
Fig. 5 (a)
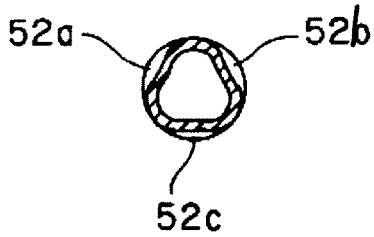
Fig. 5 (b)
Fig. 5 (c)
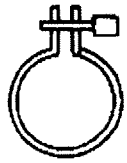
51
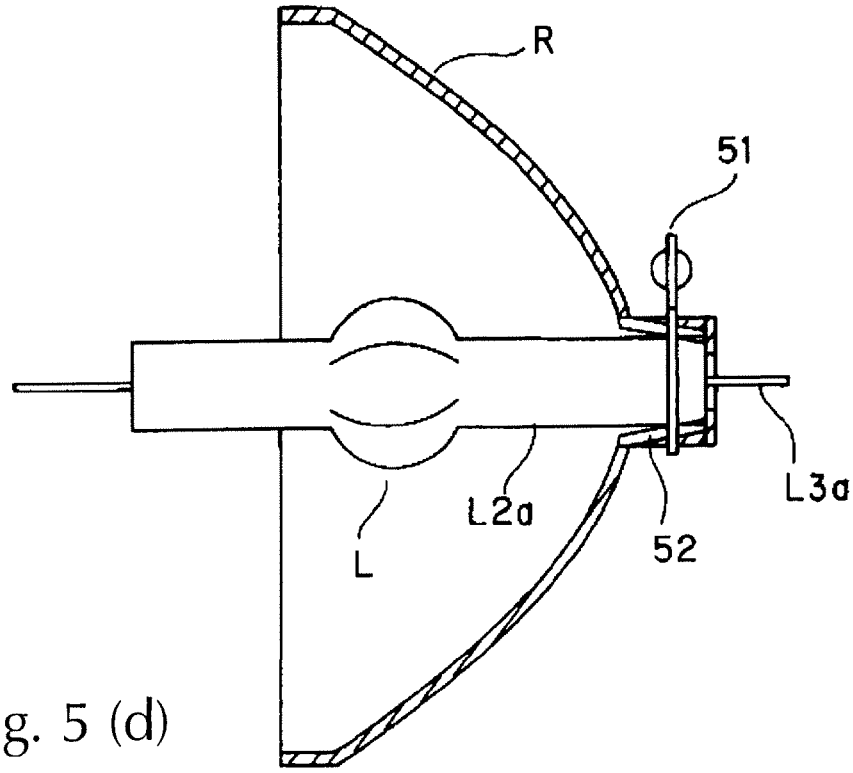
Fig. 5 (d)

LIGHT SOURCE DEVICE

BACKGROUND OF THE INVENTION

1. Field of the Invention

The invention relates to a light source device, and especially to a light source device which is used for a projector device.

2. Description of Related Art

In a projector device of the projection type, there is a demand for uniform illumination of images with sufficient color reproduction on a rectangular screen. Therefore, as the light source, a discharge lamp of the short arc type, like a mercury lamp, a metal halide lamp or the like, is integrated into the reflector and used. The reflector has an essentially concave overall shape and consists of a concave reflection part and a cylindrical neck region.

FIG. 7 schematically shows the arrangement of such a light source device which consists of a discharge lamp L and a reflector R. The fixing of the discharge lamp L and of the reflector R takes place such that the vicinity of a base B which is attached to one end of the discharge lamp is filled with an adhesive. The arc radiance spot P of the discharge lamp L must furthermore be positioned at a first focal point of the reflector R. This is because the radiant light of the discharge lamp L can be used with high efficiency when the arc radiance spot P is at the first focal point of the reflector R.

Therefore, the following sequence is undertaken to produce the light source device.

First, before filling with adhesive, the discharge lamp L is moved with simultaneous operation of the discharge lamp L such that the arc radiance spot P is located at the first focal point of the reflector R. Thus, the positional relationship to the reflector R is adjusted.

Next, filling with adhesive is performed after the arc radiance spot P has been brought into agreement with the first focal point of the reflector R. Thus, the discharge lamp L and the reflector R are attached to one another. The two can also be directly attached to one another; although; in the drawings, the discharge lamp L and the reflector R are attached via a holding component H.

This technique is described, for example, in Japanese patent application publications JP-A-2003-29338 and JP-A-2000-105425.

However, in the above described production sequence, there were the following disadvantages:

(1) For positioning of the discharge lamp relative to the reflector, devices and apparatus like a current source for operating the lamp, an optical system for illuminating the arc radiance spot, a device for measuring the illuminance, a screen and the like were necessary.

(2) In the case of using devices for measuring the illuminance, such as an optical template of an illumination meter and the like over a long time, measures against heat and correction of deterioration were necessary.

(3) Even if the discharge lamp is operated for positioning, it is necessary to wait until the radiation intensity has stabilized. Even after positioning, the discharge lamp was turned off, it was necessary to wait until it cooled off, and afterwards, the adhesive was injected. Therefore, time had to be spent for fixing of the discharge lamp and the reflector to one another.

Furthermore, since there is a demand for a very large amount of light in current projector devices, there is also a demand for very high accuracy in the positioning of the discharge lamp and the reflector relative to one another. This is because the attainable amount of light decreases greatly when the arc radiance spot of the discharge lamp and the focal point of the reflector deviate from one another.

On the other hand, the price of projector devices drops more and more from year to year. Accordingly, the price of the light source device also drops continuously. Therefore, it is desirable to be able to produce both with low costs and also to obtain a sufficient amount of light.

SUMMARY OF THE INVENTION

Therefore, a primary object of the present invention is to devise a light source device with a low price in which a sufficient amount of light can be obtained.

In accordance with the invention, in a light source device which comprises:

- a reflector of a concave reflection part and a cylindrical neck region and
- a discharge lamp which has a light emitting part and hermetically sealed portions which are attached to the two ends of the light emitting part and have a shrink seal and in which one of the hermetically sealed portions is attached in the neck region of the reflector, the above described object is achieved by the above described hermetically sealed portion being directly joined to a part of the neck region of the reflector, a processed portion being formed which determines the positional relationship between the two.

In accordance with the invention, in a light source device which comprises:

- a reflector of a concave reflection part and a cylindrical neck region and
- a discharge lamp which has a light emitting part and hermetically sealed portions which are attached to the two ends of the light emitting part and have a shrink seal, and in which one of the hermetically sealed portions is attached in the neck region of the reflector, the above described object is achieved by a holding component being attached in the hermetically sealed portion and by this holding component being directly joined to a part of the neck region of the reflector, a processed part being formed which determines the positional relationship between the two.

The object is also achieved in accordance with the invention by a front glass being attached to the reflector for closing a front opening thereof and being pressed against the other hermetically sealed portion of the discharge lamp so that a holding arrangement is thus formed which determines the positional relationship of this discharge lamp.

The object is moreover achieved in accordance with the invention, in a discharge lamp which has a light emitting part and hermetically sealed portions which are attached to the two ends of the light emitting part and have a shrink seal by a processed part which being formed on the outer surface of one of the hermetically sealed portions, the processed part being extending in a direction perpendicular to the tube axis.

The object is also achieved in accordance with the invention in a light source device which comprises:

- a metallic reflector of a concave reflection part and a cylindrical neck region and
- a discharge lamp which has a light emitting part and hermetically sealed portions which are attached to the two ends of the light emitting part and have a shrink seal and in which moreover one of the hermetically sealed portions is attached in the neck region of the reflector, by an end face of the hermetically sealed portion being pressed against the bottom of the cylindrical neck region of the reflector and by the positional relationship between the discharge lamp and the reflector being determined by an annular clamping device in the outer periphery of the neck region.

Furthermore, the object is achieved in accordance with the invention by the above described processed unit being formed by laser processing.

ACTION OF THE INVENTION

By the above described arrangement, the processed part for determining the positional relationship between the lamp and reflector is formed by one of the hermetically sealed portions of the discharge lamp being joined directly to a part of the neck region of the reflector. Therefore, positioning of these two parts relative to one another can be performed easily, and moreover, reliably without operating the discharge lamp.

Specifically, to position the discharge lamp relative to the reflector, the lamp need not be operated nor does positioning need to be performed by irradiation of a screen or the like with the radiant light of the lamp. Therefore, for the positioning process, neither devices nor apparatus like a current source for operating the lamp, an optical system for illuminating the arc radiance spot, a device for measuring the illuminance, a screen and the like are necessary. Also, since the lamp is not operated for positioning, it never happens that the optical template, the illumination meter or the like are degraded by the effect of heat. Furthermore, since the discharge lamp is never operated for the positioning effort, the effort for fixing the lamp and reflector is completed in an extremely short time.

The invention is further described below with reference to the accompanying drawings.

BRIEF DESCRIPTION OF THE DRAWINGS

FIGS. 2(*a*) to 2(*e*) each show a schematic of another light source device in accordance with the invention and parts thereof;

FIGS. 3(*a*) to 3(*e*) each show a schematic of a third light source device in accordance with the invention and parts thereof;

FIGS. 5(*a*) to 5(*d*) each show a schematic of a fifth light source device in accordance with the invention and parts thereof;

DETAILED DESCRIPTION OF THE INVENTION

Figure 1:
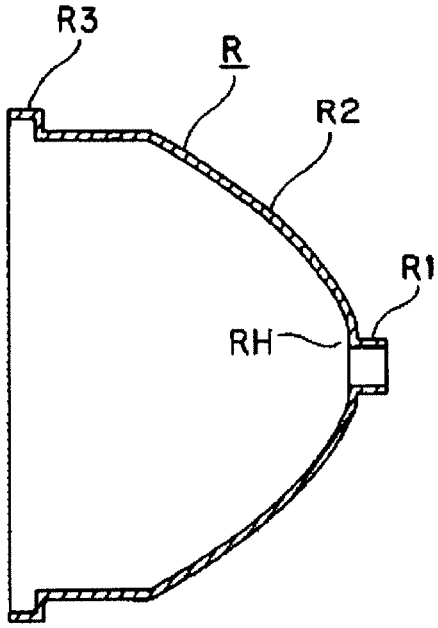
FIGS. 1(*a*) to 1(*c*) each show a schematic of a light source device in accordance with the invention and parts thereof.
Figure 1:
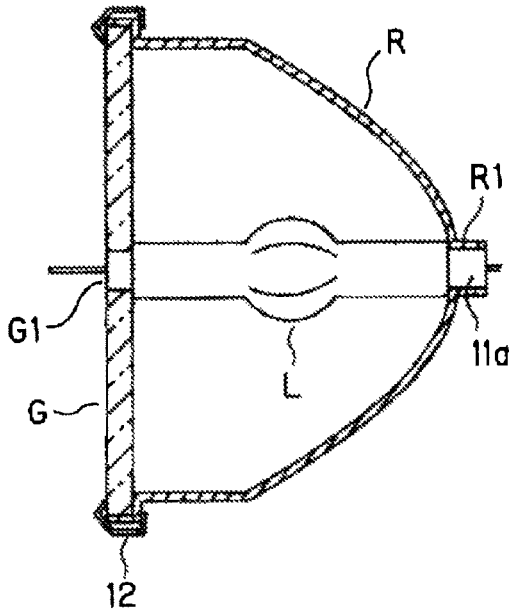
Figure 1:
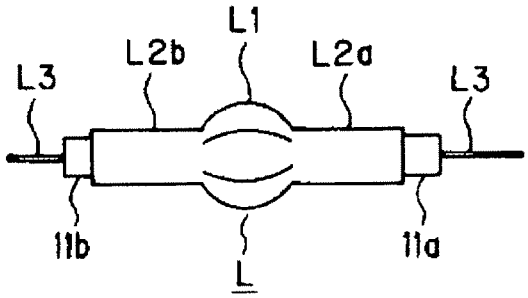

FIGS. 1(*a*), 1(*b*) and 1(*c*) each show a first version of a light source device in accordance with the invention. FIG. 1 (*a*) shows the reflector of the light source device. FIG. 1(*b*) shows the discharge lamp of the light source device. FIG. 1(*c*) schematically shows the arrangement of the light source device with the discharge lamp mounted in the reflector.

The light source device comprises a discharge lamp L, a reflector R and a front glass G. The discharge lamp L has a light emitting part L1 and hermetically sealed portions L2*a*, L2*b* that are formed by a shrink seal and are located on opposite ends thereof. The hermetically sealed portion L2*a* is installed in the neck region R1 of the reflector R. An outer lead L3 projects from the end face of each of the hermetically sealed portions L2*a*, L2*b*. The reflector R is formed altogether of a cylindrical neck region R1, a concave reflection part R2 and a front part R3.

Step-shaped processed parts 11*a*, 11*b* are formed on the ends of the hermetically sealed portions L2*a*, L2*b*. The processed part 11*a* is directly joined to a flat region RH in the neck region R1 of the reflector R, by which the positional relationship between the two is determined. The processed part is, more accurately, joined in the boundary region between the neck region R and the reflector R2. However, in the invention, this embodiment suitably is intended to be covered by the wording that the processed part is joined with the neck region of the reflector.

In this embodiment, the discharge lamp L is pressed against the flat region RH of the neck region R1 of the reflector R, while the front glass G is pressed against the front opening of the reflector R. In this case, in the middle of the front glass G, a through opening G1 (holding arrangement) is formed in which the other hermetically sealed portion L2*b* is attached. A processed part 11*b* is also formed on the tip of the other hermetically sealed portion L2*b*. The two are joined to one another.

By this arrangement, the positioning of the discharge lamp in the insertion direction is achieved by the direct joining of the processed part 11 of the discharge lamp to the flat region RH of the reflector. Positioning of the discharge lamp in the radial direction can be achieved by the outside diameter of the processed part 11 being matched to the inside diameter of the neck region R1 and being matched to the inside diameter of the through opening G1 with which the front glass G is provided. The focus position (position of the first focal point) of the reflector R and the middle position (position at which the arc radiance spot is formed) between the electrodes of the discharge lamp L can be brought into agreement with one another extremely easily and reliably.

Furthermore, by pressing the discharge lamp L with the front glass G against the reflector R, the discharge lamp L and the reflector R can be fixed. Moreover, the region between the processed part 11*a* and the neck region R1 or between the processed part 11*b* and the through opening G1 of the hermetically sealed portion can be filled with cement.

The processed parts 11*a*, 11*b* can be easily produced by vertical cutting (metal cutting) of the tip areas of the hermetically sealed portions L2*a*, L2*b*. Furthermore, for the front glass G, a spring can also be used as the locking element 12 so that the discharge lamp L can be held fast in the reflector.

As was described above, the neck region R1, the reflection part R2 and the front region R3 of the reflector R are formed of a one-piece construction. The reflection part R2 is made in the form of a paraboloid of rotation or an ellipse of rotation. The neck region R1 has essentially a cylindrical shape in order to insert and attach the hermetically sealed portion L2*a* of the discharge lamp L. The neck region R1 extends outward from the uppermost (outermost) point of the reflection part R2, and its cylindrical middle axis is coaxial with the center of rotation of the reflection part R2. The front region R3 is processed into a shape in which the front glass G can be held fast. However, it represents simply an opening if it does not have a front glass G. In this connection, it does not have the step shape shown in the drawings if the glass is not to be provided. The reflection region R2 in the front region of the paraboloid of rotation or the ellipse of rotation has a straight (cylindrical) part which, however, is not absolutely necessary, and accordingly, can also be omitted.

The neck region R1 and the reflection part R2 are made of a physically uniform material of heat resistant glass or a metallic material and overall they have a funnel shape. The heat-resistant glass is, for example, borosilicate glass or the like. Aluminum, copper or the like can be used as the metallic material. A multilayer, dielectric film for reflecting given visible radiation is vapor-deposited on the inside surface of the reflection part R2. However, in the case of a metal, if the substance can inherently reflect visible radiation, the multilayer dielectric film need not be vapor-deposited.

In the case of forming a reflector R by a metallic material, the reflection part R2, the front region R3 and the neck region R1 can be worked and formed with greater precision than in the case of formation by glass, because the metallic material can be produced in a more accurate shape than a glass material.

It is desirable that the dimensions of the inside diameter of the neck region R1 approaches the dimensions of the outside diameter of the hermetically sealed portion L2*a* of the discharge lamp L. The reason for this is the following: When the two dimensions differ greatly, positioning becomes difficult and working steps for positioning are needed.

Numerical values are described below using one example.

The outside diameter of the hermetically sealed portion L2*a* is 5.8 mm and the inside diameter of the neck region R1 is roughly 6.0 mm.

FIGS. 2(*a*) to 2(*e*) each show another version of a light source device in accordance with the invention. FIG. 2(*a*) shows the hermetically sealed portion of the discharge lamp of the light source device. FIG. 2(*b*) shows the reflector of the light source device. FIG. 2(*c*) shows the light source device. FIG. 2(*d*) schematically shows the arrangement of the component for positioning of the discharge lamp to the reflector.

This light source device differs by the configuration of the processed part of the discharge lamp and the positioning arrangement of the discharge lamp and of the reflector from the version shown in FIGS. 1(*a*) to 1(*c*). Accordingly, in this version, a front glass is not needed. As is apparent from FIG. 2(*a*), 2(*b*) and 2(*c*), in the hermetically sealed portion L1 of the discharge lamp L, a step-shaped processed part 21 is formed. A gap 22 is formed in the neck region R1 of the reflector R.

In this arrangement, the hermetically sealed portion L2*a* of the discharge lamp L is pushed into the neck region R1 of the reflector R and after positioning of the processed part 21 of the discharge lamp L in the gap 22 of the reflector R, a positioning component 23 is installed, by which the lamp L and reflector R are fixed to one another. The positioning component 23 has the arrangement shown in FIG. 2(*d*) and is formed, for example, of a roughly C-shaped ring and a pin-like component. FIG. 2(*d*) shows two different embodiments. The gap 22 of the reflector R is formed by part of the cylindrical neck region R1 being cut out, for example, in the shape of a semicircle.

The arrangements and forms of the processed part 21 of the discharge lamp L, of the gap 22 of the reflector R and of the positioning component 23 are not limited to the arrangements and shapes shown in FIGS. 2(*a*) to 2(*e*). However, since the hermetically sealed portion L2 of the discharge lamp L normally is made of silica glass, it is desirable that the positioning component 23 be produced from an elastic material and with an elastic thickness. Furthermore, the processed part 21 of the discharge lamp L and the gap 22 of the reflector R can be arranged in the direction in which the hermetically sealed portion extends, also at several locations, for example, at two locations, because the straightness of the linear direction of the light emitting part can be made exact.

This arrangement allows positioning of the discharge lamp relative to the reflector both in the insertion direction and also in the radial direction of the discharge lamp by the processed part 21 of the discharge lamp, the gap 22 of the neck region R1 of the reflector R and of the positioning component 23.

FIG. 2(*e*) shows a modified version of the arrangement shown in FIG. 2(*c*). The neck region of the reflector is formed by a two-step arrangement from a part with a small diameter R1*a* and a part with a large diameter R1*b*. It is advantageous to bring the hermetically sealed portion part L2*a* of the discharge lamp L and the neck region R1 of the reflector R closer to one another in the sense of attachment of them. However, with consideration of the adverse effect of the high heat of the discharge lamp on the reflector, it is not advantageous to move the two closer to one another. Therefore, the diameter of the neck region is reduced only in the region necessary for attachment, so that they are brought closer to one another, but the diameter of the other area of the neck region is increased and so that they are spaced away from one another outside of the area of the connection.

FIGS. 3(*a*) to 3(*e*) each show another embodiment of the light source device in accordance with the invention. FIG. 3(*a*) shows the discharge lamp of the light source device. FIG. 3(*b*) shows the reflector of the light source device. FIG. 3(*c*) shows the light source device. FIG. 3(*d*) shows an enlarged view of the region in which the reflector is installed in the discharge lamp. FIG. 3(*e*) shows a modified version of the region in which the reflector is installed in the discharge lamp. The device differs from the version shown in FIGS. 1(*a*) to 1(*c*) by the position at which the discharge lamp and the reflector are joined directly to one another.

On the end face of the hermetically sealed portion L2*a* of the discharge lamp L a step-shaped processed part 31 is formed. The step of the processed part 31 is made such that it is flat in a direction perpendicular to the center axis of the discharge lamp L. On the end of the neck region R1 of the reflector R, a bottom flange 32 is formed, in the middle of which an opening 33 is formed. The inside diameter of the opening 33 is slightly larger than the outside diameter of the processed part 31. By inserting the processed part 31 into the opening 33, positioning and attachment of the discharge lamp L relative to the reflector R can be achieved. Furthermore, an outer lead L3, which projects from the processed part 31, penetrates a metallic plate 34. By welding the metallic plate 34 to the bottom 32 of the reflector R, the two can be formed integrally with one another, and thus, the attachment can also be strengthened. For welding in the sense of preventing oxidation of the surface of the metallic plate 34, TIG welding is advantageous. When the reflector R is made of a metallic material, by welding the metallic plate 34 to the bottom 32 of the reflector R, the reflector R and the discharge lamp L are electrically connected to one another, by which measures, such as grounding of the lamp housing and the like are required. However, if necessary, the reflector R and the discharge lamp L can be electrically insulated from one another by an insulator 35 being located between the metallic plate 34 and the neck region R1 (FIG. 3(*e*). Therefore, electrical insulation of the lamp housing can also be ensured.

This manner of positioning fixes the discharge lamp in the insertion direction by joining the processed part 31 of the discharge lamp with the bottom 32 of the neck region of the reflector. The positioning of the discharge lamp in the radial direction can be achieved by inserting the outside diameter of the processed part 31 into the opening 33, strengthened by the metallic plate.

Figure 4:
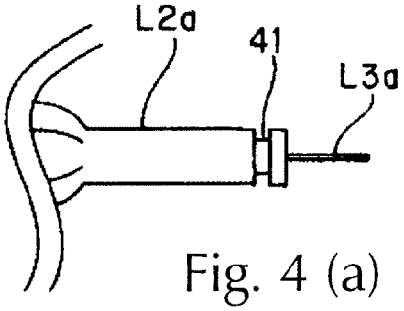
FIGS. 4(*a*) to 4(*e*) each show a schematic of another light source device in accordance with the invention and parts thereof.
Figure 4:
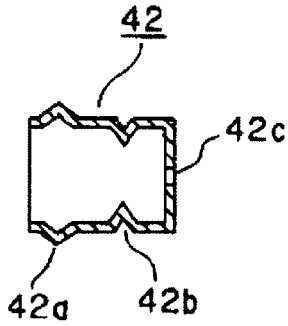
Figure 4:
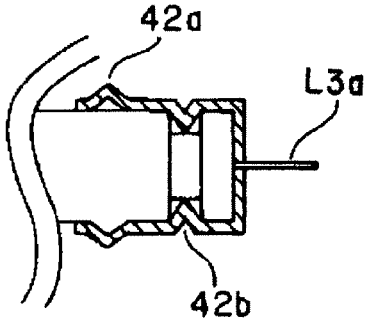
Figure 4:
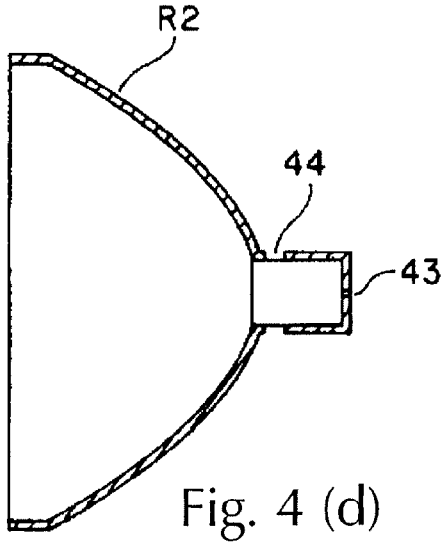
Figure 4:
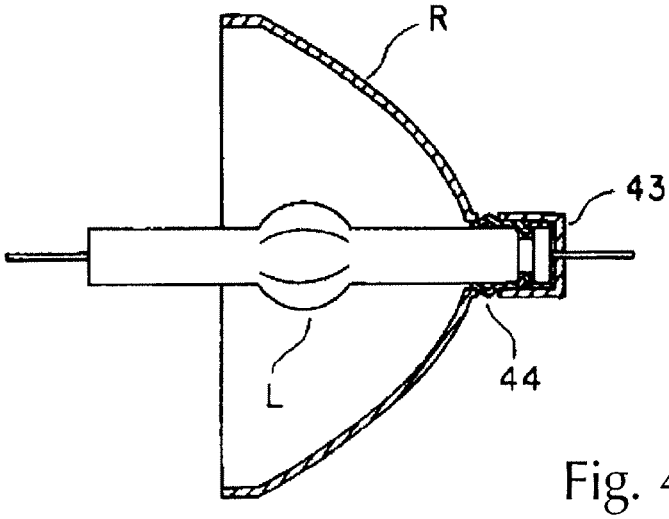

FIGS. 4(*a*) to 4(*e*) each show another version of a light source device in accordance with the invention. FIG. 4(*a*)

shows a hermetically sealed portion of the discharge lamp of the light source device. FIG. 4(*b*) shows the base in which the hermetically sealed portion is installed. FIG. 4(*c*) shows the state in which the base is attached to the hermetically sealed portion. FIG. 4(*d*) shows a reflector of the light source device. FIG. 4(*e*) shows the light source device.

The light source device differs from the version shown in FIGS. 1(*a*) to 1(*c*) by the attachment arrangement of the reflector R on the discharge lamp L. Specifically, in the arrangement shown in FIGS. 1(*a*) to 1(*c*), positioning is performed by direct joining to the reflector R, while in the arrangement shown in FIGS. 4(*a*) to 4(*e*), a base 42, as the holding component, is attached to the hermetically sealed portion L2 and is directly joined to the reflector R.

In the hermetically sealed portion L2*a* of the discharge lamp L, a groove-like processed part 41 is formed to which the base 42 is attached as the holding component. The base 42 has essentially the overall shape of a cap. The outside wall is provided with a convex part 42*a* and a concave part 42*b*. By joining the concave part 42*b* to the processed part 41 in an arrangement on the hermetically sealed portion L2*a* of the discharge lamp, the two are attached to one another in given positions. The bottom of the base 42 is provided with an opening 42*c* which penetrates the outer lead L3*a*. The burr which forms in the forming of the opening 42 can be pushed through to the outside from the base when the outer lead L3 is inserted by the measure that the inside diameter of the opening 42*c* is made slightly larger than the outside diameter of the lead L3*a*. Furthermore, by the friction force between the outer lead L3*a* and the opening 42*c*, the two can be attached to one another. Moreover, in the case in which the base 42 is made of a metallic material, the base 42 can be attached and welded to the outer lead L3 as well.

The bottom surface of the base 42, in the case of insertion into the neck region R1 of the reflector R is pressed as far as the base 43 of the neck region R1 and thus positioned. This means that the bottom area of the base 42 and the bottom surface of the neck region R1 become the reference surface in the pressing direction. In the neck region R1 of the reflector R, a gap 44 is formed. Positioning is performed by direct joining of the convex part 42*a* of the base 42 with the gap 44. The gap 44 is formed away from the focal position of the reflector R at a given distance. In this embodiment, to attach the reflector R in the discharge lamp L, another part, specifically the base 42, is needed. The work of attaching the two to one another can, however, be performed extremely easily.

By this arrangement, the positioning of the discharge lamp in the insertion direction is achieved by direct joining to (abutting with) the bottom surface of the holding component (base 42) attached in the discharge lamp and with the bottom 43 of the neck region R1 of the reflector. The positioning of the discharge lamp in the radial direction can be achieved by engaging the convex arrangement 42*a* of the holding component in the gap 44 of the reflector neck region and by the spring force of the holding part.

FIGS. 5(*a*) to 5(*d*) each show another embodiment of the light source device in accordance with the invention. FIG. 5(*a*) shows the neck region of the reflector in a cross section. FIG. 5(*b*) shows the neck region of the reflector in a cross-section along line A-A in FIG. 5(*a*). FIG. 5 (*c*) shows a clamping means 51. FIG. 5 (*d*) shows the light source device.

The feature of this version which differs from the prior embodiments is the provision of the clamping means 51 for attachment of the reflector R in the discharge lamp L and at least three recesses 52 (52*a*, 52*b*, 52*c*) on the inside surface of the neck region R1 of the reflector R that are formed radially so that the neck region R1 has an inside diameter that is slightly smaller than the outside diameter of the hermetically sealed portion L2 of the discharge lamp in order to attach to a certain extent only by inserting the hermetically sealed portion L2.

In this case, it is desirable for the neck region R1 of the reflector R in the direction toward the bottom 53 to be formed tapering with a decreasing inside diameter in order to facilitate insertion of the discharge lamp L. The reason why at least three depressions 52*a*-52*c* are necessary is to facilitate positioning toward the middle of the inside of the neck region R1 only by inserting the hermetically sealed portion L2. However, for positioning with higher precision, it is desirable that roughly six depressions are present. Furthermore, there is also a case in which there are no depressions.

In this version, it is advantageous that the reflector R is made of a metallic material in order to clamp the hermetically sealed portion L2 of the discharge lamp by spring force when it is inserted into the neck region R1, and thus, to hold it fast. If the hermetically sealed portion L2 of the discharge lamp cannot be held fast simply by the spring force of the neck region R1, the clamping means 51 shown in FIG. 5(*c*) (holding component) is needed.

In the version shown in FIGS. 5(*a*) to 5(*d*) in the case of using a front glass G as shown in FIGS. 1(*a*) to 1(*c*), instead of using the clamping means 51, also the locking element shown in FIG. 1(*c*) can be used for pressing the discharge lamp L against the reflector R to hold it fast and attached.

This arrangement enables positioning of the discharge lamp in the insertion direction by direct joining (abutting) of the end (end face) of the hermetically sealed portion L2*a* with the bottom 53 of the neck region R1 and positioning of the discharge lamp in the radial direction can be achieved by the depressions 52 formed on the inside surface of the neck region R1 and the clamping means 51.

Furthermore, the end of the hermetically sealed portion L2*a* can also be provided with the processed part shown in FIG. 1(*b*).

In the process for forming the processed parts (1*l*, 2*l*, 3*l*, 4*l*) in the discharge lamp L, irradiation with laser radiation is performed, as was described above. In the discharge lamp in accordance with the invention, the positions at which the arc radiance spot is produced at the time (essentially the middle position between the electrodes) for each lamp differ slightly from one another due to the extremely small distance between the electrodes of roughly 1 mm and because the electrode positions differ as a result of the production error and the like. Therefore, it is necessary for each discharge lamp to observe the tip positions of the electrodes with a CCD camera or the like and to determine the positions of the processed parts with reference to these positions. Furthermore, a carbon dioxide laser device can be used for this purpose.

Furthermore, there is generally a process for forming the hermetically sealed portion L2 of the discharge lamp by a pinch seal. In the case of a pinch seal, the processed part can also be formed by a tong shape in the hermetically sealed portion. However, since a sharp processed part cannot be produced by means of tongs, in positioning relative to the reflector using this processed part, the positioning accuracy cannot be adequately ensured.

In the discharge lamp in accordance with the invention, the internal pressure of the light emitting part in operation is extremely high so that, to ensure sufficient pressure resistance, a shrink sealing process is used. In accordance with the invention, after forming the hermetically sealed portion by the shrink sealing process, the processed parts are formed by laser irradiation.

Figure 6:
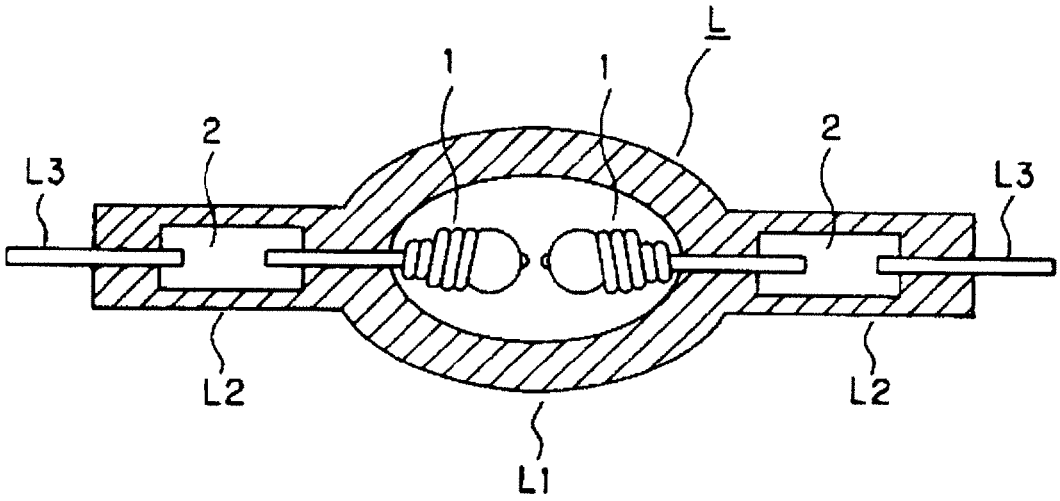
FIG. 6 is a schematic partial sectional view of an ultra-high pressure discharge lamp in accordance with the invention.

FIG. 6 shows an enlarged view of discharge lamp L. The discharge lamp L has an essentially spherical light emitting part L1 which is formed by a discharge vessel made of silica glass, and hermetically sealed portions L2*a*, L2*b* which extend from opposite ends thereof. In the light emitting part L1, there is a pair of opposed electrodes 1. In the hermetically sealed portion L2, an electrically conductive metal foil 2, which normally is made of molybdenum, is hermetically installed. The support rod of the electrode 1 is welded to the metal foil 2. The outer lead L3 is welded to the other end of the metal foil 2, by which an electrical connection is established. The arrangement of the processed part is not described, since the configuration is of different types.

When the lamp is operated, an arc radiance spot is formed essentially in the middle of the pair of electrodes (1*a*, 1*b*). This arc radiance spot P is positioned at the first focal point of the reflector R.

Figure 7:
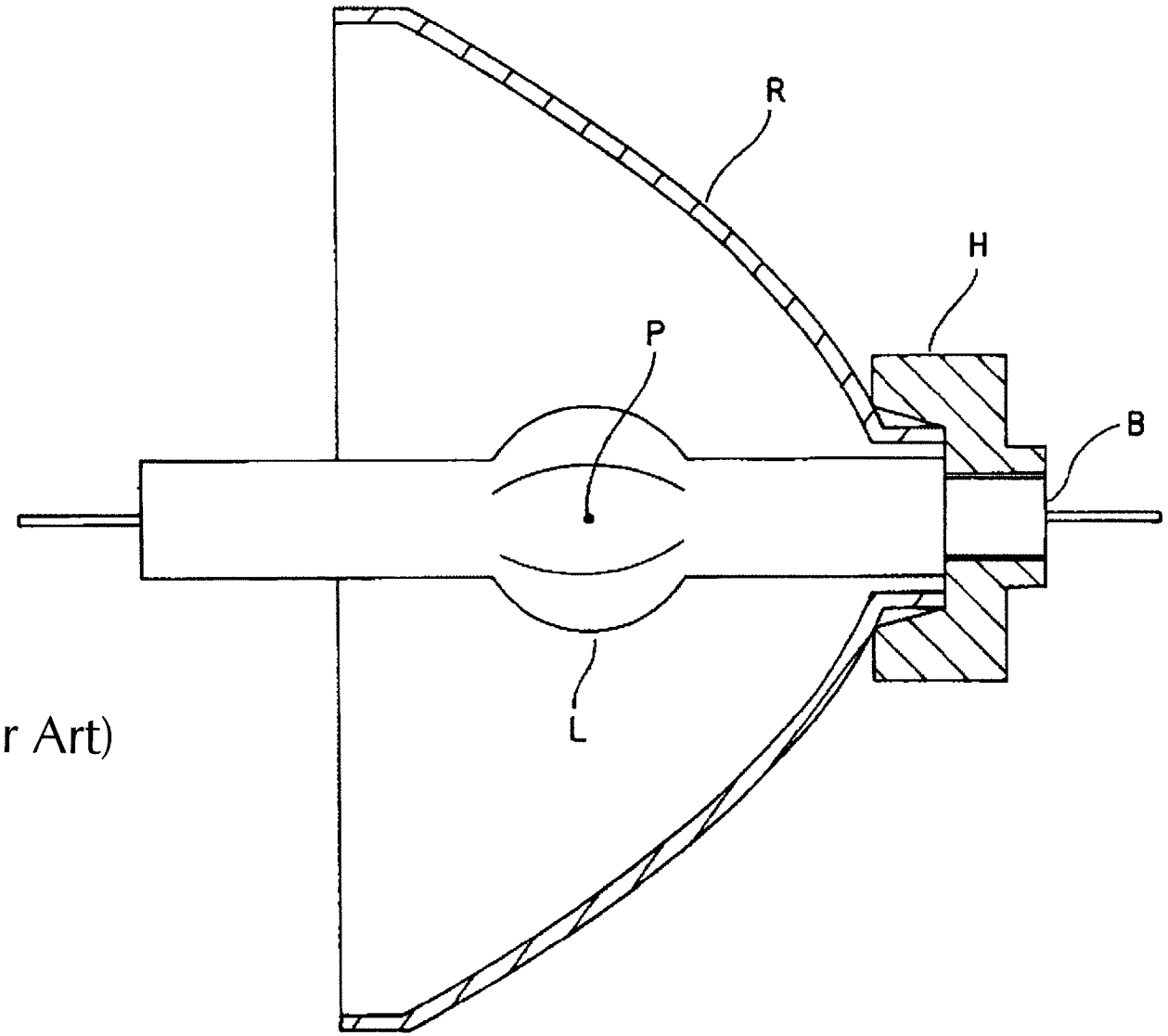
Fig. 7 (Prior Art)
FIG. 7 is a schematic partial sectional view of a conventional light source device.

On the outside surface of the end of the hermetically sealed portion, step-like processed parts 11 are formed. The processed parts 11 (11*a*, 11*b*) are formed with reference to the position at which the arc radiance spot P is formed (see, FIG. 7) at a given distance therefrom, for example, in that, during simultaneous rotation of the discharge lamp, irradiation is performed with a laser beam and notching is produced to a given depth. The position of the arc radiance spot P with respect to the distance between the electrodes can be fixed at a pre-calculated position. However, in the case of a light source of a projector device, as in the invention, the distance between the electrodes is roughly 1.0 mm, therefore small, so that the middle between the electrodes can be assumed roughly to be the arc radiance spot.

The light emitting part L1 is filled with mercury, rare gas and a halogen gas. The mercury is used to obtain the required wavelength of visible radiation, for example, to obtain radiant light with wavelengths from 360 nm to 780 nm and is added in an amount greater than 0.15 mg/mm$^3$. For this added amount, according to the temperature conditions, in operation, a vapor pressure of at least 150 atm, therefore an extremely high vapor pressure, is reached. By adding a larger amount of mercury, a discharge lamp with a high mercury vapor pressure in operation of at least 200 atm or 300 atm can be produced. The higher the mercury vapor pressure, the more suited the light source for a projector device which can be implemented. The rare gas is, for example, about 13 kPa of argon gas in order to improve the starting property. The halogen can be iodine, bromine, chlorine and the like in the form of a compound with mercury or another metal. The amount of halogen added is selected to be in the range of $10^{-6}$ μmol/mm$^3$ to $10^{-2}$ μmol/mm$^3$. The function thereof is also to prolong the service life using the halogen cycle. For an extremely small discharge lamp with an extremely high internal pressure like that of the discharge lamp in accordance with the invention, the main purpose of adding this halogen is for preventing devitrification of the discharge vessel.

Numerical values of the discharge lamp are shown below by way of example.

For example:

the maximum outside diameter of the light emitting part is 9.5 mm;

the distance between the electrodes is 1.5 mm;

the inside volume of the arc tube is 75 mm$^3$;

the rated voltage is 80 V and the rated wattage is 150 W.

The lamp is operated using an alternating current.

This discharge lamp is installed in a projector device which should be as small as possible. On the one hand, therefore, the overall dimensions of the device are extremely small while, on the other hand, there is a demand for a large amount of light. The thermal effect in the light emitting part is therefore extremely strict. The value of the wall load of the lamp is 0.8 W/mm$^2$ to 2.0 W/mm$^2$, specifically 1.5 W/mm$^2$. That the lamp has such a high mercury vapor pressure and such a high value of the wall load leads to its being able to offer radiant light with good color reproduction when it is installed in a projector device or a presentation apparatus, such as an overhead projector.

In the discharge lamp used for the light source device in accordance with the invention, the same effect can be obtained regardless of the operating type, i.e., both for direct current type of operation and also for alternating current type of operation.

As was described above, in the light source device in accordance with the invention, a processed part is formed in one of the hermetically sealed portions of the discharge lamp which, with direct joining to a part of the neck region of the reflector, determines the positional relationship between them. Therefore, without operation of the discharge lamp, the lamp and reflector can be easily, and moreover, reliably be positioned relative to one another. Furthermore, the positional relationship between the lamp and reflector can be determined by installing a holding component in the hermetically sealed portion which is joined to part of the reflector.

The specific action for positioning of the discharge lamp and of the reflector relative to one another the lamp does not need the lamp to be operated since irradiation of a screen or the like with the radiant light of the lamp is not required. Therefore, in the positioning effort, neither devices nor apparatus like a current source for operating the lamp, an optical system for illuminating the arc radiance spot, a device for measuring the illuminance, a screen or the like are necessary. Moreover, since the lamp is not operated for positioning, it never happens that an optical template, an illumination meter, and the like are degraded by heat. Furthermore, since the discharge lamp is never operated for the positioning effort, the work for fixing the two is completed in an extremely short time.

What we claim is:

1. Light source device which comprises a reflector having a concave reflection part and a cylindrical neck region and a discharge lamp which has a light emitting part and hermetically sealed portions which are attached to opposite ends of the light emitting part, one of the hermetically sealed portions being attached in the neck region of the reflector, wherein at least said one of the hermetically sealed portions that is attached in the neck region of the reflector has a step-shaped or groove-shaped processed portion, the processed portion being directly joined to a part of the neck region of the reflector, and wherein the positional relationship between the reflector and the discharge lamp is determined by the position at which the processed portion is joined to said part of the neck region of the reflector.

2. Light source device in accordance with claim 1, wherein a front glass is attached in the reflector for closing a front opening thereof, wherein the front glass presses against the other of the hermetically sealed portions of the discharge lamp so as to form a holding arrangement which determines the positional relationship of the discharge lamp relative to the front glass.

3. Light source device which comprises:

a reflector having a concave reflection part and a cylindrical neck region and a discharge lamp which has a light emitting part and hermetically sealed portions which are attached to opposite ends of the light emitting part and have hermetically sealed portions, one of which is attached in the neck region of the reflector, wherein a holding component is attached to the hermetically sealed portion, wherein the holding component is directly joined to a part of the neck region of the reflector, and wherein a processed portion is provided which is configured to co-act with the holding element to set the positional relationship between the reflector and the discharge lamp.

4. Light source device in accordance with claim 3, wherein a front glass is attached in the reflector for closing a front opening thereof, wherein the front glass presses against the other of the hermetically sealed portions of the discharge lamp so as to form a holding arrangement which determines the positional relationship of this discharge lamp relative to the reflector.

5. Discharge lamp which has a light emitting part and hermetically sealed portions which are attached to opposite ends of the light emitting part and have a shrink seal, wherein a step-shaped or groove-shaped processed part is formed on an outer surface of one of the hermetically sealed portions, the processed part extending in a direction perpendicular to a longitudinal axis of the hermetically sealed portions.

6. Light source device which comprises:

a metallic reflector of a concave reflection part and a cylindrical neck region and a discharge lamp which has a light emitting part and hermetically sealed portions which are attached to opposite ends of the light emitting part, one of the hermetically sealed portions being attached in the neck region of the reflector, wherein an end face of said one of the hermetically sealed portions is pressed against a bottom of the cylindrical neck region of the reflector and wherein the positional relationship between the discharge lamp and the reflector is determined by an annular clamping device in an outer periphery of the neck region.

* * * * *